US006484694B2

(12) United States Patent
Thomas

(10) Patent No.: US 6,484,694 B2
(45) Date of Patent: Nov. 26, 2002

(54) METHOD OF CONTROLLING AN INTERNAL COMBUSTION ENGINE

(75) Inventor: Eric D. Thomas, Canton, MI (US)

(73) Assignee: Detroit Diesel Corporation, Detroit, MI (US)

( * ) Notice: Subject to any disclaimer, the term of this patent is extended or adjusted under 35 U.S.C. 154(b) by 135 days.

(21) Appl. No.: 09/730,909

(22) Filed: Dec. 5, 2000

(65) Prior Publication Data

US 2002/0066445 A1 Jun. 6, 2002

(51) Int. Cl.[7] ..... F02D 41/14; F02P 5/153

(52) U.S. Cl. ..... 123/435; 701/102; 701/106; 73/117.3

(58) Field of Search ..... 123/435, 436, 123/305, 406.42, 406.27, 406.43, 406.22; 701/106, 102, 115; 73/115, 117.3

(56) References Cited

U.S. PATENT DOCUMENTS

| | | | | | |
|---|---|---|---|---|---|
| 4,505,152 | A | * | 3/1985 | Haddox | 73/115 |
| 4,572,133 | A | | 2/1986 | Bago | |
| 4,633,403 | A | * | 12/1986 | Asmus | 701/105 |
| 4,633,707 | A | * | 1/1987 | Haddox | 73/117.3 |
| 4,920,494 | A | * | 4/1990 | Abo et al. | 123/435 |
| 5,243,947 | A | | 9/1993 | Yamamoto et al. | |
| 5,255,209 | A | * | 10/1993 | Krebs | 701/101 |
| 5,386,723 | A | * | 2/1995 | Wier | 73/117.3 |
| 6,272,426 | B1 | * | 8/2001 | Tascillo | 123/406.42 |
| 2002/0066437 | A1 | | 6/2002 | Weisman | |
| 2002/0069011 | A1 | | 6/2002 | Hawkins et al. | |

FOREIGN PATENT DOCUMENTS

DE 2430323 A 1/1976

OTHER PUBLICATIONS

U.S. patent application Ser. No. 09/730,964, Hawkins et al.
U.S. patent application Ser. No. 09/730,943, Weisman.
U.S. patent application Ser. No. 09/730,281, Ritter et al.
U.S. patent application Ser. No. 09/730,281, Ritter et al., filed Dec. 5, 2000.

* cited by examiner

*Primary Examiner*—Hieu T. Vo
(74) *Attorney, Agent, or Firm*—Brooks & Kushman P.C.

(57) ABSTRACT

A method of controlling an internal combustion engine includes determining the pressure within the cylinder with a pressure sensor which samples at specific positions of the piston indicating the properties of the thermodynamic cycle. The engine is controlled and operating condition diagnosed in real time based on that series of cylinder pressures at corresponding piston positions.

16 Claims, 3 Drawing Sheets

METHOD OF CONTROLLING AN INTERNAL COMBUSTION ENGINE

TECHNICAL FIELD

The present invention relates to a method for controlling an internal combustion engine.

BACKGROUND ART

In the control of fuel injection systems, the conventional practice utilizes electronic control units having volatile and non-volatile memory, input and output driver circuitry, and a processor capable of executing a stored instruction set, to control the various functions of the engine and its associated systems. A particular electronic control unit communicates with numerous sensors, actuators, and other electronic control units necessary to control various functions, which may include various aspects of fuel delivery, transmission control, or many others.

Fuel injectors utilizing electronic control valves for controlling fuel injection have become widespread. This is due to the precise control over the injection event provided by electronic control valves. In operation, the electronic control unit determines an energizing or excitation time for the control valve corresponding to current engine conditions. The excitation of the control valve causes a cascade of hydraulic events leading to the lifting of the spray tip needle, which causes fuel injection to occur.

With increasing demands for fuel economy, emission control, and other aspects of engine performance, there is a need for a method of controlling an internal combustion engine with greater precision than existing control techniques.

DISCLOSURE OF INVENTION

It is therefore an object of the present invention to provide a method of controlling an internal combustion engine in real time based on cylinder pressure measurements taken during the engine cycle.

In carrying out the above object and other objects and features of the present invention, a method of controlling an internal combustion engine including an engine block defining a cylinder and a piston received in the cylinder is provided. The method comprises determining a position of the piston within the cycle, and determining a pressure within the cylinder, when the piston is at the determined position, with a pressure sensor disposed in the cylinder. The method further comprises controlling the engine in real time based on a series of cylinder pressures and corresponding piston positions.

Embodiments of the present invention are suitable for a diesel engine. Further, in a preferred implementation, the engine operates over a four stroke cycle including an intake stroke, a compression stroke, a power stroke, and an exhaust stroke.

In one embodiment, the method further comprises determining the position of the piston within the cycle at first, second, and third points on the compression stroke. Pressure within the cylinder is determined with the pressure sensor for the first, second, and third points on the compression stroke. The method further comprises determining a linear status of the compression stroke based on the cylinder pressures and corresponding piston positions for the first, second, and third points on the compression stroke. Advantageously, a linear increase in the logarithm of pressure with respect to the logarithm of volume during the compression stroke means that leakage is minimal.

In one embodiment, the method further comprises determining the position of the piston within the cycle at a plurality of points on the compression stroke and a plurality of points on the power stroke. The pressure within the cylinder is determined with a pressure sensor for the plurality of points on the compression stroke and the plurality of points on the power stroke. The method further comprises determining a net work for the cycle based on the cylinder pressures and the corresponding piston positions for the plurality of points on the compression stroke and the plurality of points on the power stroke. Advantageously, in a multiple cylinder engine, the engine may be controlled in real time to balance the power output among the multiple cylinders by, over time, measuring the net work during a cycle from each cylinder and compensating for varying work per cylinder by, for example, adjusting the fuel pulse width for each cylinder.

In some embodiments, the method further comprises determining a peak cylinder pressure for the cylinder. Further, in some embodiments, the engine includes an intake pressure sensor, and the method further comprises determining the position of the piston within the cycle at a point on the intake stroke. The method further comprises determining the pressure within the cylinder with the pressure sensor for the point on the intake stroke, and determining the intake pressure from the intake pressure sensor. An offset or zero drift of the cylinder pressure sensor is calibrated based on the intake pressure from the intake pressure sensor.

In preferred embodiments of the present invention, the pressure sensor in the cylinder has a logarithmic output. A logarithmic output sensor is preferred because during the engine cycle, the logarithm of pressure varies linearly with respect to the logarithm of volume. In the alternative, a linear output sensor may be used, but using a linear output sensor would require a larger output range for the sensor and greater precision. For example, when a sensor has an analog output, a logarithmic output sensor could require merely a 10-bit converter, while a linear output sensor would require at least a 16-bit analog-to-digital converter to input the sensor signal to the engine controller.

Further, in carrying out the present invention, a method of controlling an internal combustion engine including an engine block defining a plurality of cylinders and a plurality of pistons, with each piston received in a corresponding cylinder, is provided. The method comprises determining a position of each piston within the cycle, and measuring a pressure within each cylinder, when the corresponding piston is at the determined position. The method further comprises controlling the engine in real time based on a series of cylinder pressures, and the corresponding piston positions for the plurality of cylinders and corresponding plurality of pistons.

Still further, in carrying out the present invention, an internal combustion engine is provided. The internal combustion engine comprises an engine block defining a plurality of cylinders, a plurality of pistons with a piston received in each cylinder, and a plurality of pressure sensors with a pressure sensor configured at each cylinder to detect cylinder pressure. A crankshaft has an encoder and drives the pistons. A crankshaft sensor detects a position of the crankshaft, and allows determination of the position of each piston within its cycle. The engine further comprises a controller configured to determine a pressure within each cylinder and the position of each corresponding piston within its cycle. The controller is further configured to control the engine in real time based on a series of cylinder pressures and corresponding piston positions.

The advantages associated with embodiments of the present invention are numerous. For example, embodiments of the present invention allow real time based feedback control over the combustion process and the four stroke cycle of the engine based on a series of cylinder pressures and corresponding piston positions as detected by various engine sensors. It is appreciated that "in real time" as used herein means that a plurality of measurements taken in one or more cycles of the piston would be used to control successive cycles, sometimes called control feedback, and/or to alert the operator of an undesirable condition and/or record an event for later diagnosis. The term "in real time" as viewed in the context of the present invention is distinguished from the capture of data for academic or research purposes to be utilized at a later time or in another engine. Further, the present invention is far different than the detection of solely the maximum cylinder pressure. For example, a pressure sensor may be located in each cylinder, and a crankshaft sensor may trigger the measurements of those pressures to correspond with the crankshaft positions. Advantageously, the real time control may be utilized to achieve accurate and precise emission control and fuel economy. Further, embodiments of the present invention may utilize real time control to compensate for cylinder variabilities including injector variabilities, cylinder or injector wear and change over time, and for various operating conditions such as, for example, when a turbocharger compressor wheel becomes dirty. The real time control provided by embodiments of the present invention allows sophisticated and advanced controls with such precision to allow control of emissions during transient engine conditions in some embodiments. Embodiments of the present invention may be implemented by utilizing a crankshaft encoder and sensor along with a pressure sensor at each cylinder, such as a piezoresistive element. Embodiments of the present invention have many additional advantages than those specifically mentioned above, including the ability to diagnose failures in cylinders before damage occurs and to adapt the engine to changing operating conditions.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
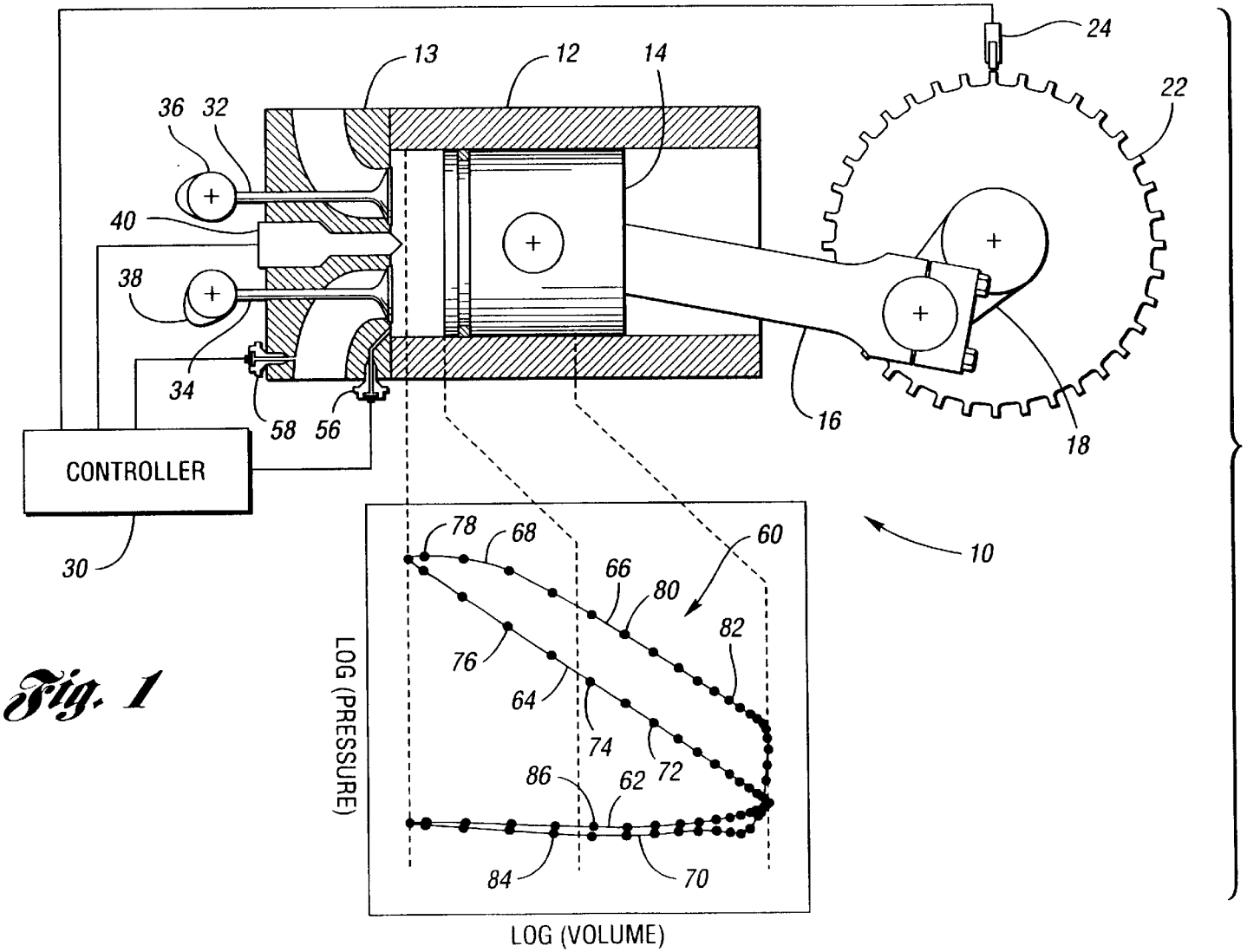
FIG. 1 is a schematic diagram of a piston and cylinder assembly and corresponding log (pressure) versus log (volume) plot for the cylinder cycle, with a controller, cylinder pressure sensor, and intake manifold pressure sensor in accordance with the present invention.

Referring to FIG. 1, an illustrative embodiment of the present invention is generally indicated at 10. As shown, engine block 12 defines a cylinder that receives piston 14. Piston 14 is connected by a connecting rod 16 to crankshaft 18. Crankshaft 18 includes an encoder wheel 22 as is known in the art. A crankshaft sensor 24 detects the position of the encoder as the crankshaft rotates. Crankshaft sensor 24 produces an output representing a series of pulses that correspond to crankshaft timing. Sensor 24 has an output received by controller 30. Controller 30, or alternatively a separate integrated circuit, decodes signals from sensor 24 so that controller 30 knows the orientation of the crankshaft and other timed engine parts at all times. It is appreciated that although only a single cylinder is shown, an engine may include any number of cylinders that may be controlled simultaneously in accordance with the present invention. A single cylinder is shown for convenience in reference and to facilitate the understanding of the present invention.

As shown, an exhaust valve 32 and an intake valve 34 are open and closed by cams 36 and 38, respectively. The cams are driven and timed in accordance with the crankshaft 18. Fuel injector 40 is controlled by controller 30 to inject fuel at the appropriate time.

It is appreciated that embodiments of the present invention are suitable for a compression-ignition diesel engine. However, embodiments of the present invention are not limited to a particular cycle, and as such, compression-ignition and spark-ignition engines may be controlled in accordance with the present invention. Plot 60 illustrates the cylinder undergoing the standard diesel cycle. However, it is appreciated that in the alternative, embodiments of the present invention may control the engine over the Otto cycle, or over any other cycle. With continuing reference to FIG. 1, the diesel cycle 60 includes an intake stroke 62, a compression stroke 64, a power stroke 66, including relatively constant pressure portion 68 during which combustion of the fuel occurs, and an exhaust stroke 70. Again, the cycle may vary significantly from that illustrated and the present invention is not limited to any particular cycle, but rather is illustrated with the diesel cycle. In accordance with the present invention, at various points on the cycle, cylinder pressure is measured by sensor 56 and corresponding cylinder volume is determined by the engine controller based on the crankshaft position. As such, controller 30 knows the engine cycle and may make adjustments to fuel injection control strategies based on the cycle to increase performance.

For example, as shown, points 72, 74, and 76 on the compression stroke may be detected to determine a linear status of the compression stroke. That is, because during proper compression, the logarithm of pressure varies linearly with respect to the logarithm of volume, sampling points 72, 74, and 76 allow the engine controller to determine whether or not compression is occurring properly (without significant leakage). In the event that the compression stroke is nonlinear (on the logarithm scale), fueling of the cylinder may be disabled and a fault logged.

Further, in accordance with the present invention, point 78 may be sampled, at either a specific encoder position or as a peak-and-hold maximum value, so that controller 30 knows the peak pressure in the cylinder during the cycle. It is appreciated that the term sampled as used herein to designate sampling of points on the cycle of plot 60 means that the pressure is measured by pressure sensor 56 and the volume of the cylinder at that time is determined by controller 30 based on inputs from crankshaft sensor 24.

Further, in addition to sampling points along the compression stroke, points 80, 82 along the power stroke may be sampled. A sampling of a plurality of points on the compression stroke and a plurality of points on the power stroke allow controller 30 to determine the net work produced by a cylinder (power stroke work minus compression stroke work). Advantageously, controller 30 may adjust the fuel pulse width to injector 40 to the various cylinders of a multiple cylinder engine to equalize the work per cylinder in real time.

Further, in accordance with the present invention, an offset of pressure sensor 56 may be calibrated to compensate for any zero drift by an independent pressure sensor. For example, intake manifold pressure may be measured by an intake manifold pressure sensor 58. Sensor 56 may sample pressure at point 86 on the intake stroke, allowing controller 30 to calibrate measurements made by pressure sensor 56. Alternatively, an exhaust manifold pressure sensor may be utilized to allow calibration of sensor 56 by sampling point 84 on the exhaust stroke. The intake pressure sensor is preferred for turbocharged engines, however, an exhaust pressure sensor could be utilized in non-turbocharged engines.

In accordance with the present invention, real time closed loop control of injection may be accomplished by utilizing a crankshaft sensor and a pressure sensor in each cylinder. The many advantages include, for example, the ability to accurately and precisely control emissions and fuel economy in addition to compensating for engine variabilities and the ability to equalize the work per cylinder.

Figure 2:
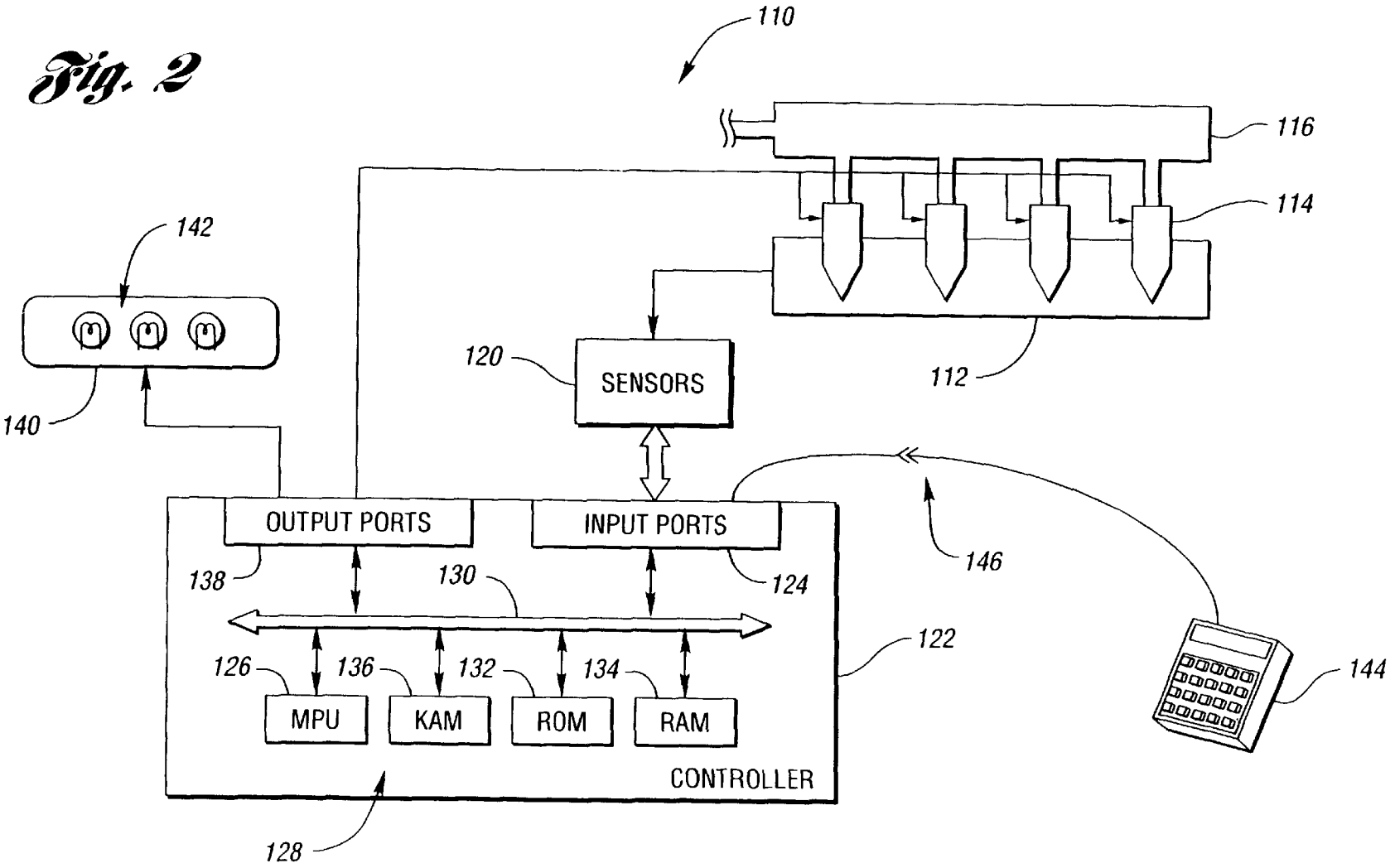
FIG. 2 is a schematic diagram of an engine and associated engine control system of the present invention.

Referring now to FIG. 2, a system for enhanced fuel injection in internal combustion engines is shown. The system, generally indicated by reference numeral 110, includes an engine 112 having a plurality of cylinders, each fed by fuel injectors 114. In a preferred embodiment, engine 112 is a compression-ignition internal combustion engine, such as a four, six, eight, twelve, sixteen or twenty-four-cylinder diesel engine, or a diesel engine having any other desired number of cylinders. The fuel injectors 114 are shown receiving fuel from a supply 116 as is well known in the art.

The system 110 may also include various sensors 120 for generating signals indicative of corresponding operational conditions or parameters of engine 112, the vehicle transmission (not shown), and other vehicular components. Sensors 120 are in electrical communication with a controller 122 via input ports 124. Controller 122 preferably includes a microprocessor 126 in communication with various computer readable storage media 128 via data and control bus 130. Computer readable storage media 128 may include any of a number of known devices which function as a read-only memory (ROM) 132, random access memory (RAM) 134, keep-alive memory (KAM) 136 such as non-volatile RAM, and the like. The computer readable storage media may be implemented by any of a number of known physical devices capable of storing data representing instructions executable via a computer such as controller 122. Known devices may include, but are not limited to, PROM, EPROM, EEPROM, flash memory, and the like in addition to magnetic, optical, and combination media capable of temporary or permanent data storage.

Computer readable storage media 128 include various program instructions, software, and control logic to effect control of various systems and subsystems of the vehicle, such as engine 112, vehicle transmission, and the like. Controller 122 receives signals from sensors 120 via input ports 124 and generates output signals which may be provided to various actuators and/or components via output ports 138. Signals may also be provided to a display device 140 which includes various indicators such as lights 142 to communicate information relative to system operation to the operator of the vehicle.

A data, diagnostics, and programming interface 144 may also be selectively connected to controller 122 via a plug 146 to exchange various information therebetween. Interface 144 may be used to change values within the computer readable storage media 128, such as configuration settings, calibration variables including adjustment factor look-up tables, control logic and the like.

In operation, controller 122 receives signals from sensors 120 and executes control logic embedded in hardware and/or software to allow real time control over fuel injection based on cylinder pressure and volume feed back during the engine cycle. In a preferred embodiment, controller 122 is the DDEC controller available from Detroit Diesel Corporation, Detroit, Mich.

As will be appreciated by one of ordinary skill in the art, the control logic may be implemented or effected in hardware, software, or a combination of hardware and software. The various functions are preferably effected by a programmed microprocessor, such as the DDEC controller, but may include one or more functions implemented by dedicated electric, electronic, or integrated circuits. As will also be appreciated, the control logic may be implemented using any one of a number of known programming and processing techniques or strategies and is not limited to the order or sequence illustrated here for convenience. For example, interrupt or event driven processing is typically employed in real-time control applications, such as control of a vehicle engine or transmission. Likewise, parallel processing or multi-tasking systems and methods may be used to accomplish the objects, features, and advantages of the present invention. The present invention is independent of the particular programming language, operating system, or processor used to implement the control logic illustrated.

Figure 3:
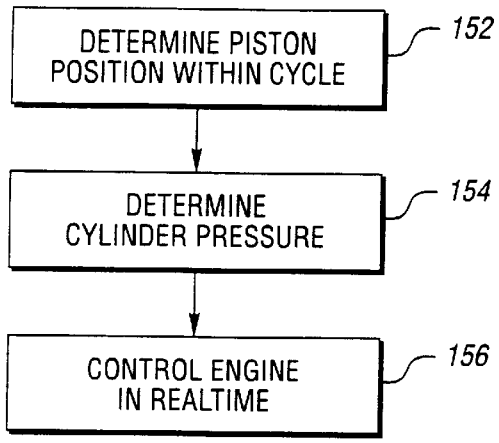
FIG. 3 is a block diagram illustrating a method of the present invention for controlling an internal combustion engine.

FIGS. 3–6 illustrate various methods of the present invention. In FIG. 3, piston position within the engine cycle is determined at block 152. At block 154, cylinder pressure is determined (for the position determined in block 152). At block 156, the engine is controlled in real time based on a series of cylinder pressures and corresponding piston positions.

Figure 4:
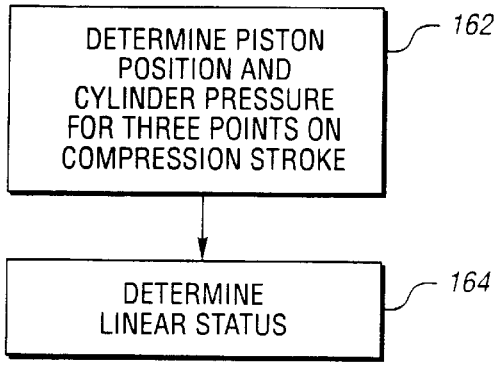
FIG. 4 is a block diagram illustrating a method of the present invention for determining a linear status of a compression stroke.

In FIG. 4, at block 162, piston position and cylinder pressure are determined for three points on the compression stroke. At block 164, a linear status of compression stroke is determined. That is, because the logarithm of pressure varies linearly with respect to the logarithm of volume during normal compression, linear status of compression may indicate whether or not there is any leakage. That is, non-linear pressure falloff indicates a leaking cylinder which may be disabled.

Figure 5:
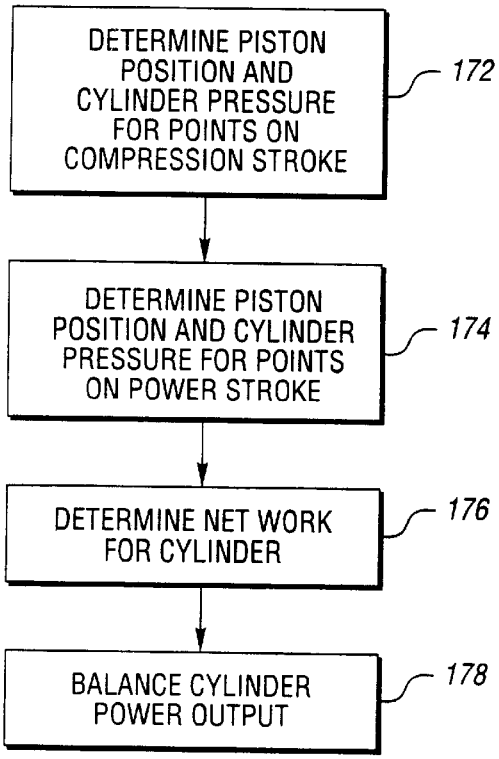
FIG. 5 is a block diagram illustrating a method of the present invention for balancing cylinder power output.

In FIG. 5, at block 172, piston position and cylinder pressure are determined for a plurality of points on the compression stroke and preferably the peak pressure value at point 78 or an assumption thereof is also determined. At block 174, piston position and cylinder pressure are determined for a plurality of points on the power stroke. At block 176, a net work is determined for the cylinder. At block 178, cylinder power output is balanced for the various cylinders of a multiple cylinder engine.

Figure 6:
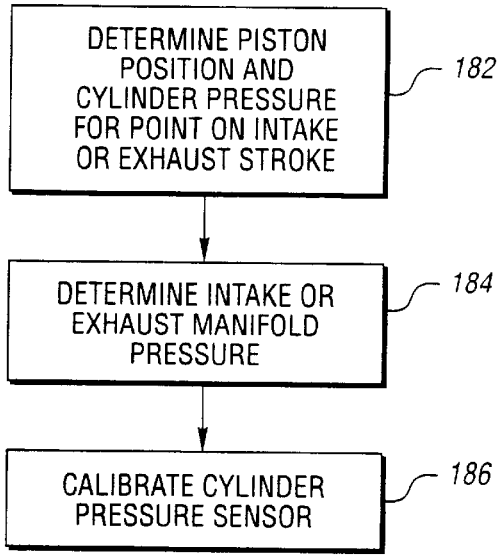
FIG. 6 is a block diagram illustrating a method of the present invention for calibrating a cylinder pressure sensor.

In FIG. 6, a method of calibrating the cylinder pressure sensor is illustrated. At block 182, piston position and cylinder pressure are determined for a point on the intake (or on the exhaust) stroke. At block 184, intake (or exhaust) manifold pressure is determined with an intake (or exhaust) sensor. At block 186, an offset of the pressure sensor is calibrated to compensate for zero drift. That is, an intake manifold pressure sensor may be utilized together with a sample point on the intake stroke to calibrate an offset of the sensor, or in the alternative, an exhaust manifold pressure sensor may be utilized together with an exhaust stroke point on the exhaust stroke to calibrate an offset of the sensor.

Further, it is to be appreciated that the plurality of points on the compression stroke may be utilized to calibrate a gain of the pressure sensor in the cylinder. That is, embodiments of the present invention may calibrate for an offset or zero drift of the sensor in addition to calibrating the sensor gain. Specifically, the gain of the sensor may be calibrated when there is not any significant leakage in the cylinder. When the cylinder is not leaking, the points sampled on the compression stroke will be logarithmically straight and have a slope of a known scientific value due to the thermodynamic properties of air in the cylinder, and have an offset as determined, preferably, by an intake pressure sensor. If the sample points on the compression stroke are not logarithmically straight when the offset is taken into consideration, then there is either a leak in the cylinder or a defective sensor. In contrast, when the sensor is working and the compression is linear on the logarithmic scale, a slope of the compression stroke may be determined from the sample points on the compression stroke. The determined slope, together with a predetermined slope of the compression stroke based on thermodynamic properties, may be used to calibrate the gain of the sensor. That is, embodiments of the present invention preferably calibrate a gain of the cylinder pressure sensor based on the determined slope of the compression stroke (based on positions and pressures for a plurality of points on the compression stroke), and further based on a predetermined slope of the compression stroke wherein the predetermined slope is based on thermodynamic properties of the engine cycle.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An internal combustion engine comprising:

an engine block defining a plurality of cylinders;

a plurality of pistons with a piston received in each cylinder;

a plurality of pressure sensors with a pressure sensor configured at each cylinder to detect cylinder pressure;

a crankshaft having an encoder, the crankshaft driving the pistons;

a crankshaft sensor for detecting a position of the crankshaft, allowing determination of the position of each piston within its cycle; and a controller configured to determine a pressure within each cylinder and the position of each corresponding piston within its cycle, and further configured to control the engine in real time based on a series of cylinder pressures and corresponding piston positions including determining a net work for the cycle for each piston based on the cylinder pressures and corresponding piston positions.

2. A method of controlling an internal combustion engine including an engine block defining a cylinder and a piston received in the cylinder, the method comprising:

determining a position of the piston within the cycle;

determining a pressure within the cylinder, when the piston is at the determined position, with a pressure sensor disposed in the cylinder;

controlling the engine in real time based on a series of cylinder pressures and corresponding piston positions wherein the engine operates over a four stroke cycle including an intake stroke, a compression stroke, a power stroke, and an exhaust stroke;

determining the position of the piston within the cycle at a plurality of points on the compression stroke and a plurality of points on the power stroke;

determining the pressure within the cylinder with the pressure sensor for the plurality of points on the compression stroke and the plurality of points on the power stroke; and determining a net work for the cycle based on the cylinder pressures and corresponding piston positions for the plurality of points on the compression stroke and the plurality of points on the power stroke.

3. The method of claim 2, wherein the engine is a diesel engine.

4. The method of claim 2, further comprising:

determining the position of the piston within the cycle at first, second, and third points on the compression stroke;

determining the pressure within the cylinder with the pressure sensor for the first, second, and third points on the compression stroke; and determining a linear status of the compression stroke based on the cylinder pressures and corresponding piston positions for the first, second and third points on the compression stroke.

5. The method of claim 2 further comprising:

determining a peak cylinder pressure for the cylinder.

6. A method of controlling an internal combustion engine including an engine block defining a cylinder and a piston received in the cylinder, the method comprising:

determining a position of the piston within the cycle;

determining a pressure within the cylinder, when the piston is at the determined position, with a pressure sensor disposed in the cylinder; and controlling the engine in real time based on a series of cylinder pressures and corresponding piston positions wherein the pressure sensor has a logarithmic output.

7. A method of controlling an internal combustion engine including an engine block defining a plurality of cylinders and a plurality of pistons, each piston received in a corresponding cylinder, the method comprising:

determining a position of each piston within the cycle;

measuring a pressure within each cylinder, when the corresponding piston is at the determined position; and controlling the engine in real time based on a series of cylinder pressures and corresponding piston positions for the plurality of cylinders and corresponding plurality of pistons wherein the pressure for each cylinder is measured with a pressure sensor has a logarithmic output.

8. A method of controlling an internal combustion engine including an engine block defining a cylinder and a piston received in the cylinder, the method comprising:

determining a position of the piston within the cycle;

determining a pressure within the cylinder, when the piston is at the determined position, with a pressure sensor disposed in the cylinder;

controlling the engine in real time based on a series of cylinder pressures and corresponding piston positions wherein the engine operates over a four stroke cycle including an intake stroke, a compression stroke, a power stroke, and an exhaust stroke; and wherein the engine includes an intake pressure sensor;

determining the position of the piston within the cycle at a point on the intake stroke;

determining the pressure within the cylinder with the pressure sensor for the point on the intake stroke;

determining the intake pressure form the intake pressure sensor; and calibrating an offset of the cylinder pressure sensor based on the intake pressure from the intake pressure sensor.

9. The method of claim 8 further comprising:

determining the position of the piston within the cycle at a plurality of points on the compression stroke;

determining the pressure within the cylinder with the pressure sensor for the plurality of points on the compression stroke;

determining a slope of the compression stroke based on the position and pressures for the plurality of points;

calibrating a gain of the cylinder pressure sensor based on the determined slope of the compression stroke and a predetermined slope of the compression stroke, wherein the predetermined slope is based on thermodynamic properties of the engine cycle.

10. A method of controlling an internal combustion engine including an engine block defining a plurality of cylinders and a plurality of pistons, each piston received in a corresponding cylinder, the method comprising:

determining a position of each piston within the cycle;

measuring a pressure within each cylinder, when the corresponding piston is at the determined position;

controlling the engine in real time based on a series of cylinder pressures and corresponding piston positions for the plurality of cylinders and corresponding plurality of pistons wherein the engine operates over a four stroke cycle including an intake stroke, a compression stroke, a power stroke, and an exhaust stroke and wherein the engine includes an intake pressure sensor;

determining the position of each piston within the cycle at a point on the intake stroke;

determining the pressure within each cylinder for the point on the intake stroke for the corresponding piston;

determining the intake pressure from the intake pressure sensor; and calibrating an offset of the pressure measurements for each cylinder based on the intake pressure from the intake pressure sensor.

11. The method of claim 10 further comprising:

determining the position of each piston within the cycle at a plurality of points on the compression stroke;

determining the pressure within each cylinder for the plurality of points on the compression stroke for the corresponding piston;

determining a slope of the compression stroke based on the positions and pressures for the plurality of points; and calibrating a gain of the pressure measurements for each cylinder based on the determined slope of the compression stroke and a predetermined slope of the compression stroke, wherein the predetermined slope is based on thermodynamic properties of the engine cycle.

12. A method of controlling an internal combustion engine including an engine block defining a plurality of cylinders and a plurality of pistons, each piston received in a corresponding cylinder, the method comprising:

determining a position of each piston within the cycle;

measuring a pressure within each cylinder, when the corresponding piston is at the determined position;

controlling the engine in real time based on a series of cylinder pressures and corresponding piston positions for the plurality of cylinders and corresponding plurality of pistons wherein the engine operates over a four stroke cycle including an intake stroke, a compression stroke, a power stroke, and an exhaust stroke;

determining the position of each piston within the cycle at a plurality of points on the compression stroke and a plurality of points on the power stroke;

determining the pressure within each cylinder for the plurality of points on the compression stroke and the plurality of points on the power stroke for the corresponding piston; and determining a net work for the cycle for each piston based on the cylinder pressures and corresponding piston positions for the plurality of points on the compression stroke and the plurality of points on the power stroke.

13. The method of claim 12 wherein the engine is a diesel engine.

14. The method of claim 12 further comprising:

determining the position of each piston within the cycle at first, second, and third points on the compression stroke;

determining the pressure within each cylinder for the first, second, and third points on the compression stroke for the corresponding piston; and determining a linear status of the compression stroke for each piston based on the cylinder pressures and corresponding piston positions for the first, second and third points on the compression stroke.

15. The method of claim 12 further comprising:

determining a peak cylinder pressure for each cylinder.

16. A method of controlling an internal combustion engine including an engine block defining a plurality of cylinders and a plurality of pistons, each piston received in a corresponding cylinder, the method comprising:

determining a position of each piston within the cycle;

measuring a pressure within each cylinder, when the corresponding piston is at the determined position;

controlling the engine in real time based on a series of cylinder pressures and corresponding piston positions for the plurality of cylinders and corresponding plurality of pistons wherein the engine operates over a four stroke cycle including an intake stroke, a compression stroke, a power stroke, and an exhaust stroke;

determining the position of each piston within the cycle at a plurality of points on the compression stroke and a plurality of points on the power stroke;

determining the pressure within each cylinder for the plurality of points on the compression stroke and the plurality of points on the power stroke for the corresponding piston;

determining a net work for the cycle for each piston based on the cylinder pressures and corresponding piston positions for the plurality of points on the compression stroke and the plurality of points on the power stroke; and controlling the engine based on the net work for the cycle for each piston to balance the power output from each engine cylinder.

* * * * *